US005970684A

United States Patent [19]

Talley, Jr.

[11] Patent Number: 5,970,684

[45] Date of Patent: Oct. 26, 1999

[54] LEVERAGE PLATE FOR CEREAL BOXES AND THE LIKE

[76] Inventor: Frances A. Talley, Jr., 1401 Maywood Rd., Richmond, Va. 23229

[21] Appl. No.: 09/111,733

[22] Filed: Jul. 8, 1998

[51] Int. Cl.[6] ..... B65B 43/26

[52] U.S. Cl. ..... 53/384.1; 53/390; 248/99

[58] Field of Search ..... 53/384.1, 390, 53/393, 492; 83/946; 141/391; 248/95, 99; 414/411, 412; 493/309, 963

[56] References Cited

U.S. PATENT DOCUMENTS 4,832,290 5/1989 Baglio .
4,854,530 8/1989 Baglio .
4,921,196 5/1990 Rudko .
4,984,758 1/1991 Young .
5,167,390 12/1992 Baghdadi .

*Primary Examiner*—Daniel B. Moon
*Attorney, Agent, or Firm*—Low and Low

[57] ABSTRACT

A plate to facilitate the application of leverage forces onto the upper portions of a top line seal on a cereal bag in a carton, for example, whereby separating the upper bag portions and rupturing the seal can be effected by persons of limited manipulative strength as well as by those who encounter difficulty in opening such seals, whereby use of sharp implements is avoided. The plate includes a narrower slot for receiving the bag upper portions communicating with a wider central aperture whereat separating forces are applied. The plate is of sufficient width to permit the knuckles and fingers of the hand to bear against the plate for leverage when tearing the seal.

10 Claims, 2 Drawing Sheets

LEVERAGE PLATE FOR CEREAL BOXES AND THE LIKE

BACKGROUND OF THE INVENTION

With the development of modern plastic film and film laminates which when formed into pouches or bags are capable of serving as oxygen and moisture barriers to protect contents of the bags, the same have come into widespread use for consumer goods, of which a typical example is use of such bags or pouches to receive dry cereal and which are disposed within exterior cardboard cartons.

Such bags may be formed in a variety of well known ways including diverse pleats and seal lines as desired by the cereal or other packager. All such bags, however, include a seal at the top of the bag along a line slightly below the top of the bag material. The filled cereal bag of usually somewhat translucent plastic is packaged within an outer cardboard box or carton having suitable printing and decoration thereon. The cereal bag is usually tack sealed to the inside of the box to prevent undesired shifting of the same during shipping and handling whereby the top of the bag will remain disposed within the carton generally proximate the top of the box. The outer box is provided with openable top flaps to gain access to the sealed cereal bag within the carton.

To dispense the cereal, it is necessary after lifting the carton top flaps to then open the bag at the top of the carton by one means or another. As indicated, such bags are usually transversely sealed, commonly by a heat seal of the plastic bag material or the facing laminate surfaces thereof.

The bag seal or seals along with the plastic film guarantee freshness of the cereal product therewithin, but by the same token, often present substantial difficulty to the consumer in opening the bag. The plastic film is relatively slick and hard to grasp firmly. Further, the unsealed generally "V-shaped" free end of the bag above the top transverse seal is of relatively short height, adding to the problem in seizing and trying to pull the seal open by lateral force on the bag material. This is especially true of those persons of limited finger and hand strength.

As a consequence, oftentimes in the struggle to open the bag, the hands slip and effect major tears in the outside carton stock, causing contents storage and leakage problems when the inside bag is finally opened. In other cases, knives are used in an effort to pierce the bag and cut the same open, with obvious handling hazards. Scissors are occasionally employed, but require manipulation in the limited space available to reach below the seal to cut the tough film bag.

There thus exists a need for a practical, inexpensive, and non-hazardous means for opening such sealed cereal bags and other containers having similar seals that are difficult to separate to access the bag contents.

BRIEF SUMMARY OF THE INVENTION

I have discovered that a generally preferably oval-shaped plate having a particularly configured tapered loop or keyhole shaped leverage opening and adjacent bag receiving narrow slot areas therein facilitates and greatly eases the separation of the top line seal of a cereal bag or the like.

The upper unsealed portion of the bag is inserted upwardly through the plate opening, and a major portion of the seal area is disposed in the narrow slot portion of the plate, with a short length of the top extending upwardly through the wider portion of the plate opening.

In so positioning the top of the bag, the user is enabled to exert a focussed force on the small portion of the bag extending through the larger opening with the remainder of the bag top seal being essentially free of pulling stress.

The larger opening portion of the plate included rounded or bevelled edges to prevent accidental and unwanted tearing of the bag as the user pulls the free upper portions apart and toward the sides edges of the larger opening.

Preferably, the plate member further includes a transverse slot forwardly of and spaced from the leverage opening for the purpose of receiving an upstanding end flap of the cereal box therethrough to aid in stabilizing the carton and the leverage plate thereon.

BRIEF DESCRIPTION OF THE DRAWINGS

The invention will be better understood from the attached drawings, in which.

DESCRIPTION OF THE PREFERRED EMBODIMENT

Figure 1:
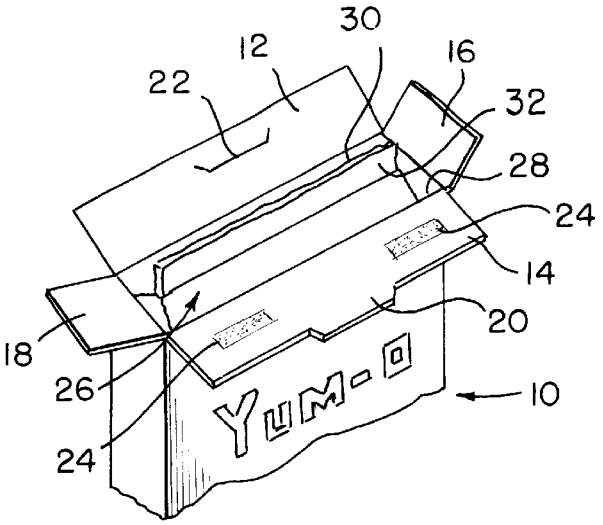
FIG. 1 is a fragmentary perspective view of a box, as a cereal box, with the top flaps open and the top of the inner cereal bag in view.
Figure 2:
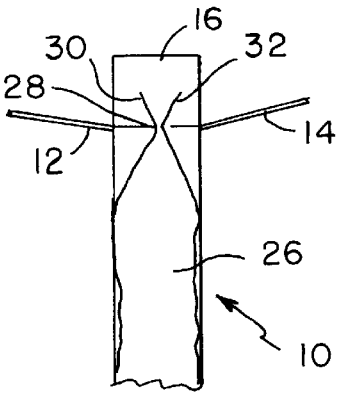
FIG. 2 is a diagrammatic end view of the box of FIG. 1.

Referring to the drawings, there is shown a box or carton 10, as a box of dry cereal, having usual top closure flaps, as a pair of longer side flaps 12 and 14, and a pair of short end flaps 16, 18. The side flaps are conventionally provided with reclosure latch means as a tongue and slot 20, 22.

In practice in initially closing the carton at the factory, the end flaps 16, 18 are infolded and the side flaps 12, 14 folded thereover with the side flaps adhesively secured as by adhesive areas 24. The flaps are readily pulled apart by rupturing the tack adhesive 24, and opened to the position of FIG. 1 by the consumer when it is desired to gain access to the contents.

Within the carton is the sealed bag 26 of cereal or other contents. The bag 26 as noted is conventionally formed from suitably folded plastic film or film laminates, and after filling, is sealed at the top along a seal line 28. Such seals are commonly heat seals, and may also be present at other areas of the bag, depending upon the particular mode of bag manufacture, all as well known in the art. The top seal 28, and any other seals employed on the bag, confine the contents within the bag without any opening to ambient air which would contaminate the product or cause the same to become stale and tasteless. In this regard, the bag film itself is of conventional character so as to be an oxygen and moisture barrier to safeguard the contents when sealed and shipped.

The top seal 28 is disposed generally parallel to the top of the bag, but spaced downwardly therefrom a short distance on the order of ½"–1" to provide two unsealed upper bag portions 30, 32 extending above the seal 28.

Figure 3:
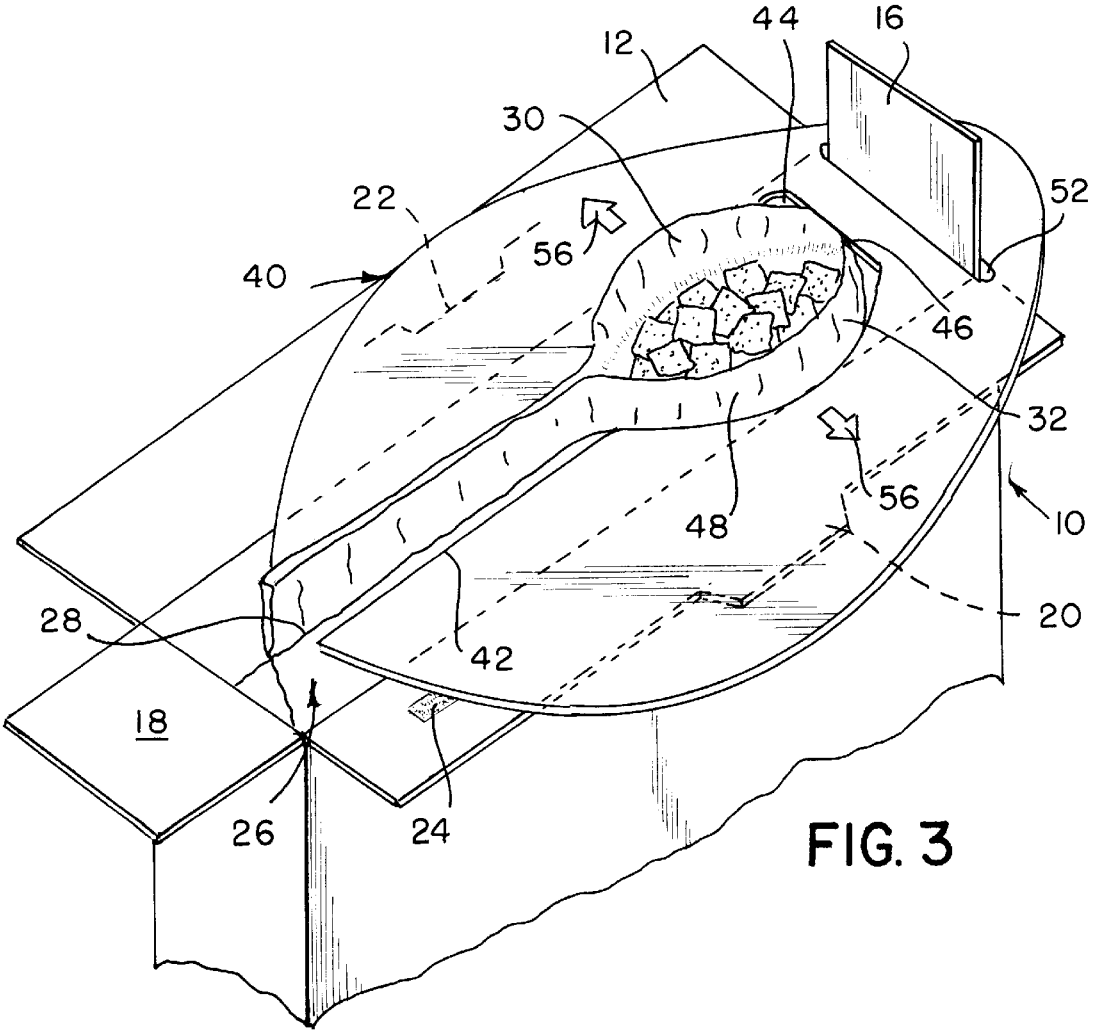
FIG. 3 is a larger perspective view similar to FIG. 1 but showing the leverage plate in position and the cereal bag opened.
Figure 4:
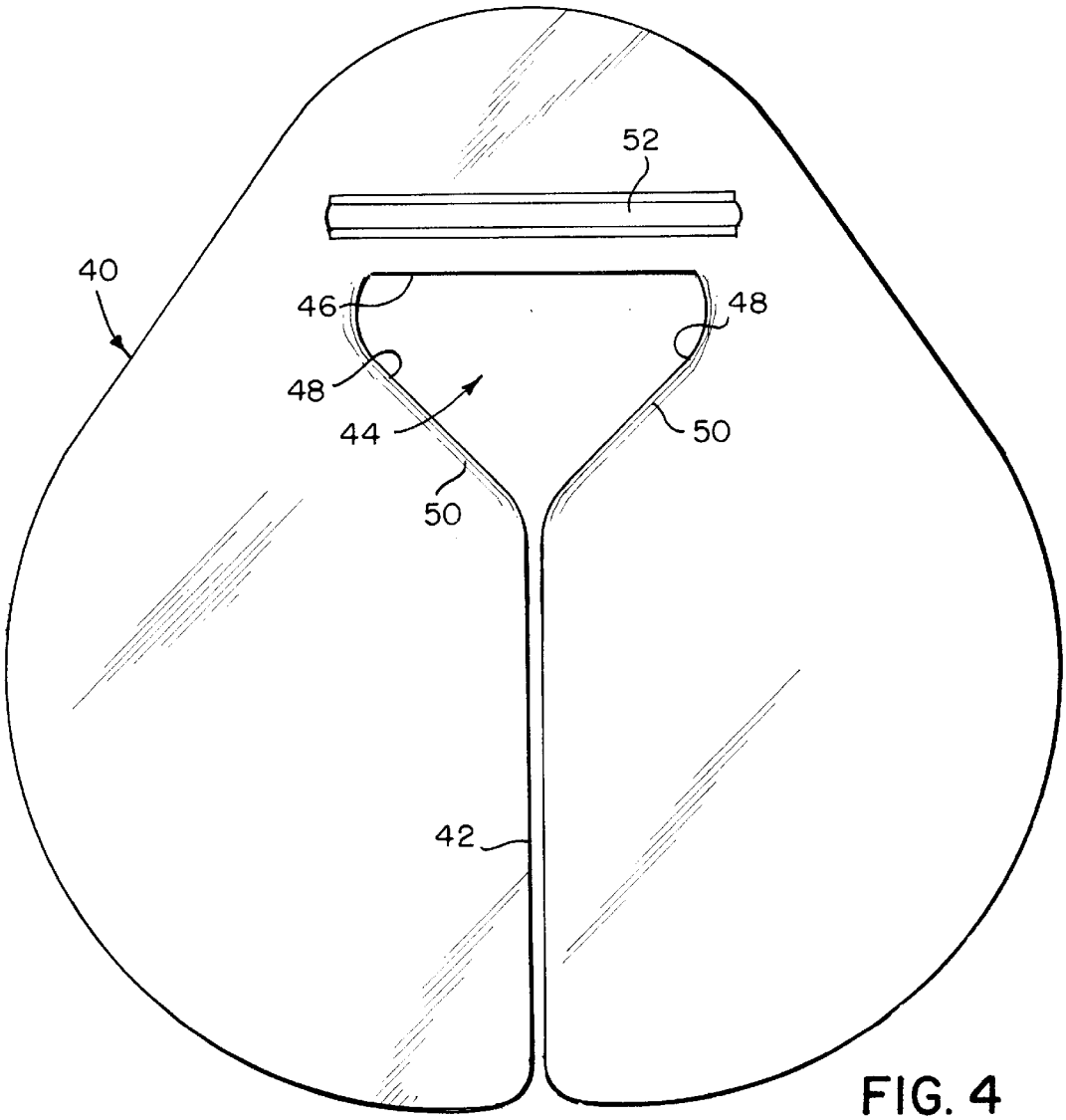
FIG. 4 is a plan view of the leverage plate.

To open the bag 26, it is necessary to pull apart the upper bag portions 30, 32 to rupture the seal 28 along at least part of its length as seen in FIG. 3, whereupon the contents of the bag may be poured from the carton.

Hitherto, as earlier noted, efforts to pull open the bag are often met with frustration due to the firm seal 28, and result in inadvertent tearing of carton as the fingers slip from the bag, or require the use of a hazardous tool as a knife in an effort to pierce and tear the bag. Further, younger persons or those with any infirmities in the hands find it hard to successfully grasp, hold, and tear open the bag as the upper portion of the bag sits somewhat loosely in the top of the carton.

To greatly facilitate opening of the seal 28 on such bags, the invention herein provides a leverage plate 40 of relatively rigid plastic, as illustratively, LEXAN plastic. The plate may conveniently be transparent as shown to aid in easily locating the same with respect to the carton 10 and bag 26, but obviously may be opaque or colored as desired.

The plate as shown is of generally oval configuration, and its thickness is not critical just so long as the plate is easily handled. In one actual embodiment plate 40 is about ⅜" in thickness for good rigidity as well as to aid in storing the same either vertically or horizontally in the kitchen area.

Plate 40 is provided with a slot 42 extending from one open end about one-half of its length, merging into a wider opening or central aperture 44 of roughly triangular form as shown. The opening 44 is closed at its forward end 46, and the curved sides 48, 48 thereof do not form sharp edges about the opening 44, but are gently rounded or bevelled as seen at 50 to avoid any possible tearing or snagging of the bag material on the plate.

Plate 40 is further provided with a transverse slot 52, which is also preferably rounded at the inside edges of the plate. The slot is disposed forwardly of and spaced from aperture 44, and has a width is amply sufficient to receive an end flap 16 of the box to extend therethrough when using the plate.

In use, as seen in FIG. 3, the plate 40 is positioned over the open top of the box, wherein the ample width of the plate makes for ease of handling and positioning the same at the carton. The seal 28 and the bag upper portions 30, 32 are slid into plate slot 42, and the plate is relatively stabilized by the flexing and insertion of end flap 16 into forward slot 52 on the plate.

When so positioned, the relative forwardmost areas of the unsealed upper bag portions 30, 32 lie in the wide opening 44 of the plate, while the major length of the sealed bag upper portion lie rearwardly and confined relatively closely by slot 42.

Thereupon, the loose upper bag portions 30 and 32 in the plate opening 44 are seized by the fingers and pulled firmly apart in the direction of arrows 56. The fingers and knuckles of the hand are enabled to rest upon plate 40 outwardly of opening 44 and used as levers or fulcrums to apply increased separating forces to upper bag portions 30, 32, thereat. Carton end flap 16 disposed in slot 52 serves to relatively stabilize the plate 40 as separating and rupturing forces are applied to bag seal 28.

In this manner, the seal 28 is more readily broken and the upper portions 30, 32 widely separated as seen in FIG. 3 to expose and gain access to the box contents.

To facilitate the leverage action of the fingers or other portions of the hand upon plate 40 in laterally outwardly spaced relationship to the opening 44, the plate 40 is of sufficient width to accommodate the knuckles or other hand portions outwardly of opening 44, and as seen is preferably of relatively wide oval configuration. The plate 40 is thus seen to be a simple, sturdy, and reliable device to facilitate applying additional seal rupturing forces on line sealed plastic bags as sets forth.

In one specific embodiment of the invention as seen in FIG. 3, the oval leverage plate 40 is approximately 8" in both width and length at the maximum dimensions of the plate, with narrow slot 42 of about 5" length, while the central opening 44 is on the order of 2½" wide at its greatest point, and about 1¾" length extending forwardly from slot 42. The carton end flap slot 52 is on the order of 3" wide to accommodate virtually all cereal cartons and the like, and about ⅜" high. As indicated, plate 40 is on the order of ⅜" thick for ease of handling.

Figure 5:
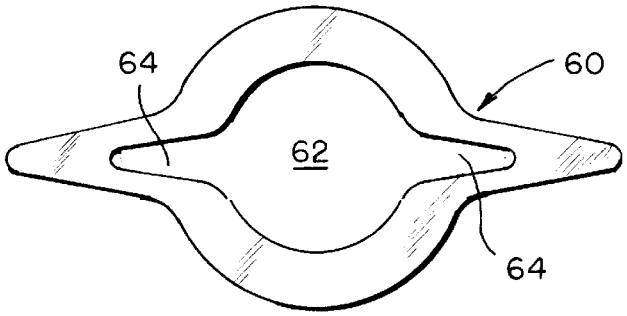
FIG. 5 is a plan view of a modified form of the invention.

FIG. 5 shows a modification of the invention wherein a forwardmost slot of modified plate 60 is absent, and the overall design is symmetrical. There is no end open slot as at 42 in FIG. 3, but rather the modified plate 60 includes a larger central opening 62 with like tapering and narrowing closed slots 64 on either side thereof. As before, the bag upper portion at above seal 28 is extended upwardly through the slots 62, 64, with the forward and rear ends of the bag seal area generally more confined in the tapered slots 62, 64. Digital pressure assisted by proximity of the wider plate area outside of the central opening 62 as before assists in easily tearing the seal 28 to open the bag.

While I have shown preferred and modified forms of my invention, it will be evident that the inventive features thereof may be incorporated in leverage plates of other and somewhat differing configurations without departing from my invention as defined within the scope of the appended claims. The plate 40, for example, may be formed of rigid cardboard or metal if desired.

What I claim is:

1. A leverage plate for assisting in opening top sealed bags in boxes, with said bags having an elongated top seal disposed beneath substantially parallel and unsealed upper portions of the bag, with said bags received in cartons having top closure flaps, comprising, a substantially planar plate member including laterally extending areas thereof, said plate member having a central aperture of substantial width, and, said plate member further having a slot opening of substantially narrower width and communicating with said central opening, whereby upon inserting the bag upper portions through said plate aperture and slot adjacent the seal, the upper bag portions disposed in said central aperture may be grasped and separated to rupture the seal by pulling outwardly thereon in opposite directions while bearing portions of one's hand against the plate member for increased leverage.

2. The leverage plate of claim 1 further including a transverse slot adjacent one end of said central aperture, thereby to receive an upstanding carton end flap through said transverse slot and stabilize said plate member upon said carton.

3. The leverage plate of claim 2 wherein said plate is of generally oval configuration, thereby to provide sufficient lateral areas thereon to receive the hands in rupturing the bag seal.

4. The leverage plate of claim 1 wherein said plate is of generally oval configuration, thereby to provide sufficient lateral areas thereon to receive the hands in rupturing the bag seal.

5. The leverage plate of claim 1 wherein said narrow slot opening extends about one half the length of said plate from its juncture with said central aperture and toward and communicates at its opposite end with the outer periphery of said plate.

6. The leverage plate of claim 5 wherein said plate is formed from substantially rigid plastic material.

7. The leverage plate of claim 5 wherein said plate is on the order of 8" in width and height dimensions.

8. The leverage plate of claim 1 wherein said plate peripheral portion bounding said central aperture is generally rounded to avoid sharp edges thereat when rupturing the bag seal.

9. The leverage plate of claim 1 further including a transverse slot adjacent one end of said central aperture, said plate is of generally oval configuration, said narrow slot opening extends at least one half the height of said plate between from its juncture with said central aperture, and, said narrow slot communicates at its opposite end with the outer periphery of said plate, whereby the upstanding bag portions above the seal may be easily slid into the narrow slot and toward said central aperture, and wherein a carton end flap is extended into said transverse slot to stabilize the plate on the carton in use, thereby to receive an upstanding carton end flap through said transverse slot and stabilize said plate member upon said carton.

10. The leverage plate of claim 9 wherein said plate is of generally oval configuration, thereby to provide sufficient lateral areas thereon to receive the hands to facilitate rupturing the bag seal.

* * * * *